US007995784B2

(12) United States Patent
Iwata

(10) Patent No.: US 7,995,784 B2
(45) Date of Patent: Aug. 9, 2011

(54) SPEAKER DEVICE

(75) Inventor: Takeshi Iwata, Yamagata (JP)

(73) Assignees: Pioneer Corporation, Tokyo (JP); Tohoku Pioneer Corporation, Tendo, Yamagata (JP)

( * ) Notice: Subject to any disclaimer, the term of this patent is extended or adjusted under 35 U.S.C. 154(b) by 1170 days.

(21) Appl. No.: 11/492,854

(22) Filed: Jul. 26, 2006

(65) Prior Publication Data

US 2007/0025584 A1 Feb. 1, 2007

(30) Foreign Application Priority Data

Jul. 29, 2005 (JP) ..... 2005-221810

(51) Int. Cl.
*H04R 25/00* (2006.01)

(52) U.S. Cl. ..... 381/386; 381/394; 381/409

(58) Field of Classification Search ..... 381/86, 381/87, 332–334, 336, 386, 389, 391, 395, 381/189, 409, 410, 394; 181/141, 150, 199; 439/65, 736, 869
See application file for complete search history.

(56) References Cited

U.S. PATENT DOCUMENTS 5,331,119 A * 7/1994 Leger et al. ..... 181/150
5,414,229 A * 5/1995 Rocheleau et al. ..... 181/150
5,778,086 A * 7/1998 Tanabe ..... 381/386
6,457,547 B2 * 10/2002 Novitschitsch ..... 181/150

FOREIGN PATENT DOCUMENTS

| | | |
|---|---|---|
| JP | 50-147624 | 5/1974 |
| JP | 54-75733 | 11/1977 |
| JP | 6-138523 | 5/1994 |
| JP | H 6-44288 | 6/1994 |
| JP | 2001-251694 | 9/2001 |
| JP | 2003-274473 | 9/2003 |

* cited by examiner

*Primary Examiner* — Huyen D Le
(74) *Attorney, Agent, or Firm* — Arent Fox, LLP

(57) ABSTRACT

It is an object of the invention to provide an improved speaker device equipped with an attachment member having formed thereon a reinforcing portion capable of inhibiting a deterioration of a sound characteristic. Another object of the invention is to provide an improved speaker device capable of efficiently disposing in a limited space close to the speaker an electronic element for controlling a signal being supplied to the speaker. The speaker device comprises a speaker unit, an attachment member for attaching the speaker unit to an attachment base. The attachment member comprises an attachment portion for attaching the attachment member to the attachment base, an attachment hole for attaching the speaker unit, a convex reinforcing portion formed along an entire or partial circumference of the attachment hole of the attachment member. The reinforcing portion has an inclined surface formed on the inner side thereof facing the side wall of the speaker unit.

12 Claims, 16 Drawing Sheets

1

PRIOR ART

24

SPEAKER DEVICE

BACKGROUND OF THE INVENTION

The present invention relates to a speaker device.

The present application claims priority from Japanese Application No. 2005-221810, the disclosure of which is incorporated herein by reference.

Generally, when a speaker is to be fixed to an attachment base such as a vehicle, an attachment member (an attachment bracket) is often used to complete such a fixation (for example, refer to Japanese Unexamined Patent Application Publication No. 2003-274473).

As shown in FIG. 1, a speaker device 1J comprises: a magnetic circuit including a frame 10, a plate 11 attached to the bottom of the frame 10, a magnet 12, and a yoke 13; a voice coil 14 disposed within a magnetic gap formed between the frame 11 and the yoke 13 and driven by an electric signal supplied thereto; a voice-coil bobbin 15 wound by the voice coil 14; a damper 16 supporting the voice-coil bobbin 15 on the frame 10; a diaphragm 17 having its inner perimeter supported on the voice-coil bobbin 15 and outer perimeter supported through its edge portion 17A on the outer perimeter 10A of the frame 10; and a dust cap 17B formed in the central portion of the diaphragm 17. Such a speaker device 1J is attached to an attachment base through an attachment member 20J, in a manner shown in FIG. 1.

On the other hand, various efforts have been made to improve the attachment member 20J so as to set the speaker device within a limited space in a more efficient way.

For example, a cylindrical reinforcing rib 23J is formed on the attachment member 20J to increase an attachment strength, as shown in FIG. 1. However, an internal cylindrical space defined by the inner wall 23Ja of the reinforcing rib 23J can disturb a sound characteristic of the speaker. In detail, as shown in FIG. 1, an air vibration is generated under the diaphragm 17 due to the vibration of the diaphragm 17 and such an air vibration will produce a resonance phenomena in the cylindrical space defined by the reinforcing rib 23J through an opening 10B of the frame 10. In fact, such a resonance phenomena can increase a sound pressure in one specific frequency band but can reduce a sound pressure in another frequency band, thus undesirably enlarging a difference between peak and dip in an entire frequency band. Further, as shown in FIG. 1, an air flow generated through the vibration of the diaphragm 17 will be impeded by the inner surface 23Ja of the reinforcing rib 23, undesirably restricting the movement of the diaphragm 17 and thus resulting in a low sound characteristic.

Moreover, where a loud-sound speaker is equipped with an electronic device such as a capacitor which is for use in a high pass filter in order to control a signal being supplied to the speaker, such an electronic device is directly connected by soldering to a speaker terminal section in the speaker frame, so as to ensure an appropriate installation of the electronic device within a limited space. However, it is still difficult to install a large size capacitor or a plurality of electronic devices in a limited space close to the speaker.

SUMMARY OF THE INVENTION

The present invention is to solve the aforementioned problem and makes this as one of its tasks. Namely, it is an object of the present invention to provide an improved speaker device equipped with an attachment member having formed thereon a reinforcing portion capable of inhibiting a deterioration of a sound characteristic. Another object of the present invention is to provide an improved speaker device capable of efficiently disposing in a limited space close to the speaker an electronic element for controlling a signal being supplied to the speaker.

In order to achieve the above objects, the present invention is characterized by at least the following aspect.

According to the present invention there is provided a speaker device having a speaker unit and an attachment member for attaching the speaker unit to an attachment base. The attachment member comprises: an attachment portion to be attached to the attachment base; an attachment hole for fitting the speaker unit; and a convex reinforcing portion formed along an entire or partial circumference of the attachment hole. In particular, the reinforcing portion has an inclined surface formed on the inner side thereof facing a side wall of the speaker unit.

BRIEF DESCRIPTION OF THE DRAWINGS

These and other objects and advantages of the present invention will become clear from the following description with reference to the accompanying drawings, wherein:

FIGS. 2A and 2B are views showing a speaker device formed according to one embodiment of the present invention, in which FIG. 2A is a front view and FIG. 2B is a side view;

FIGS. 18A to 18C are views showing another example of a protection rib, in which FIG. 18A is a side view, FIG. 18B is a sectional view taken along B-B line shown in FIG. 18A, and FIG. 18C is a perspective view.

DETAILED DESCRIPTION OF THE PREFERRED EMBODIMENTS

A speaker device according to one embodiment of the present invention comprises a speaker unit, an attachment member for attaching the speaker unit to an attachment base. The attachment member comprises an attachment portion for attaching the attachment member to the attachment base, an attachment hole for attaching the speaker unit, a convex reinforcing portion formed along an entire or partial circumference of the attachment hole of the attachment member. The reinforcing portion has an inclined surface formed on the inner side thereof facing the side wall of the speaker unit.

With the speaker device having the foregoing structure, since the reinforcing portion has an inclined surface formed on the inner side thereof facing the side wall of the speaker unit, an air compressional wave generated by the vibration of the diaphragm of the speaker unit can be reflected on the inclined surface formed on the inner side of the reinforcing portion and then emitted out of the space formed by the reinforcing portion. As a result, it is possible to reduce an undesired resonance phenomena in the space formed by the reinforcing portion, thereby inhibiting a deterioration of a sound characteristic of the speaker unit. Moreover, since an air compressional wave generated by the vibration of the diaphragm of the speaker unit can be smoothly discharged by virtue of the inclined surface of the reinforcing portion, there would be no unnecessary restriction on the vibration of the diaphragm, thereby making it possible to reduce a turbulence of the sound characteristic.

One embodiment of the present invention will be described with reference to the accompanying drawings.

Figure 1:
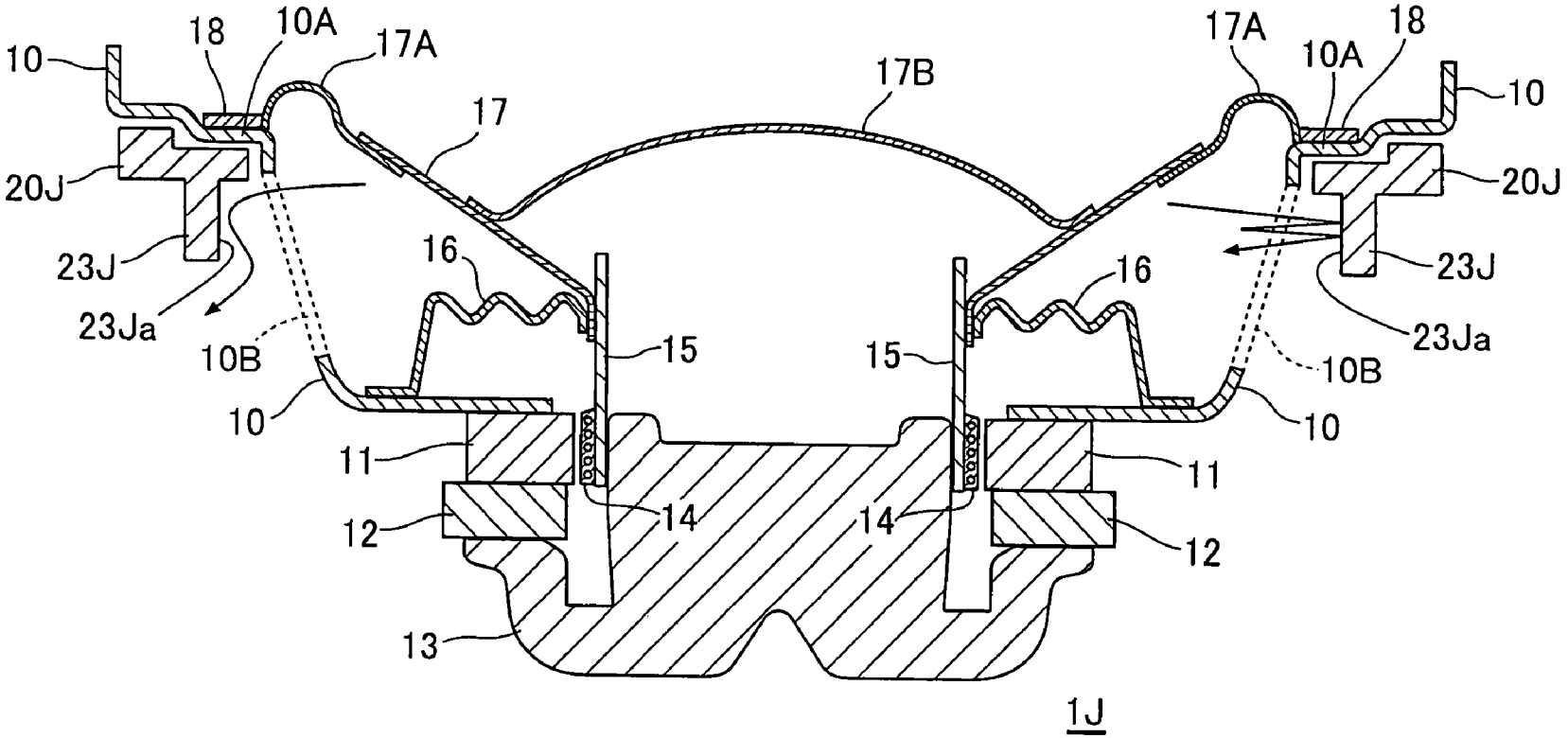
FIG. 1 is a sectional view showing a conventional speaker device.
Figure 2B:
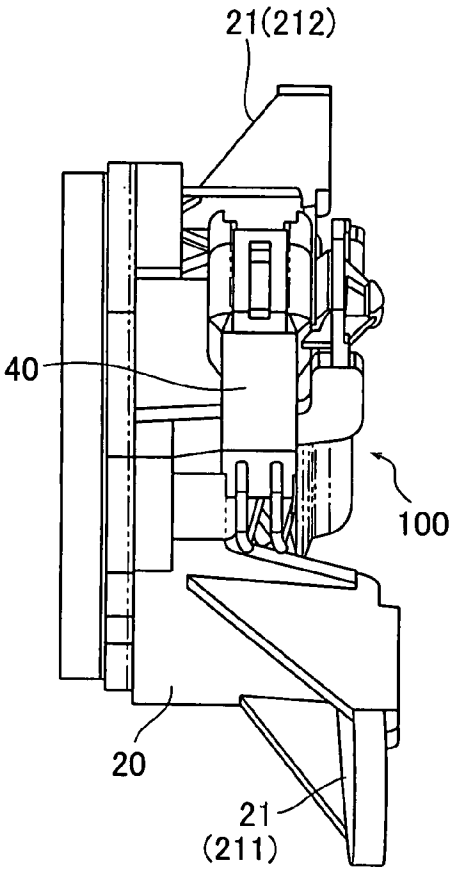
Figure 2A:
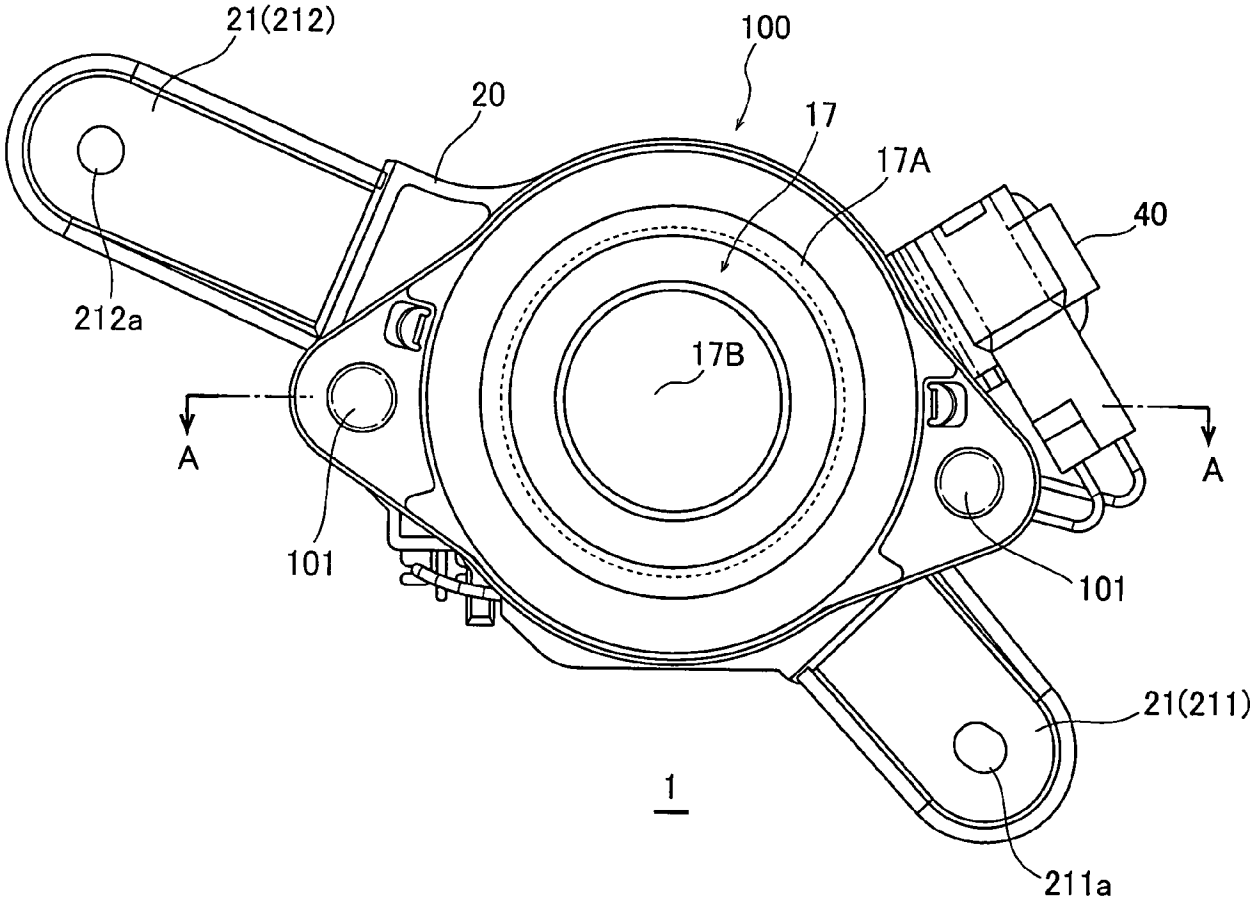
Figure 3:
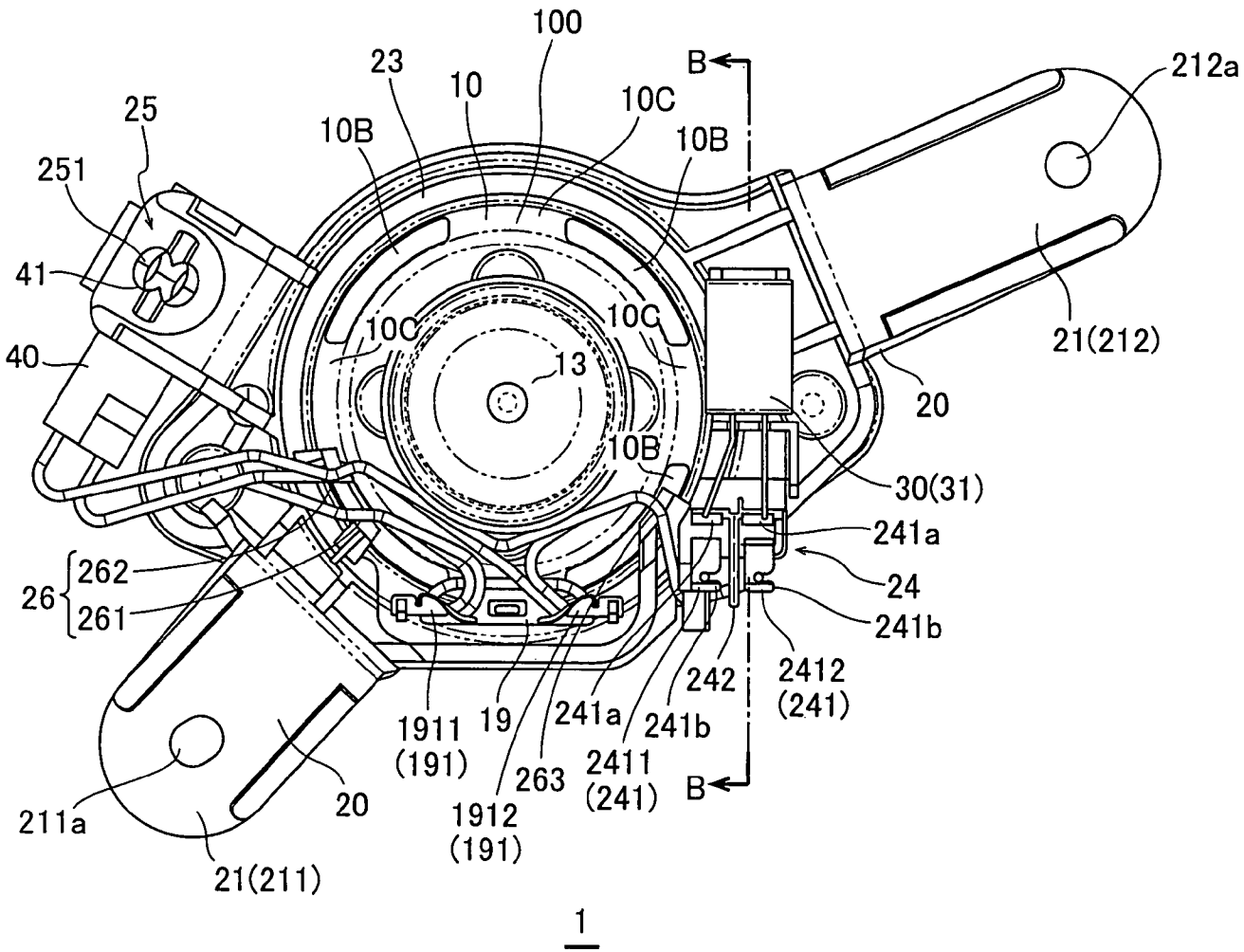
FIG. 3 is an explanatory view showing a backside of the speaker device illustrated in FIG. 2.
Figure 4A:
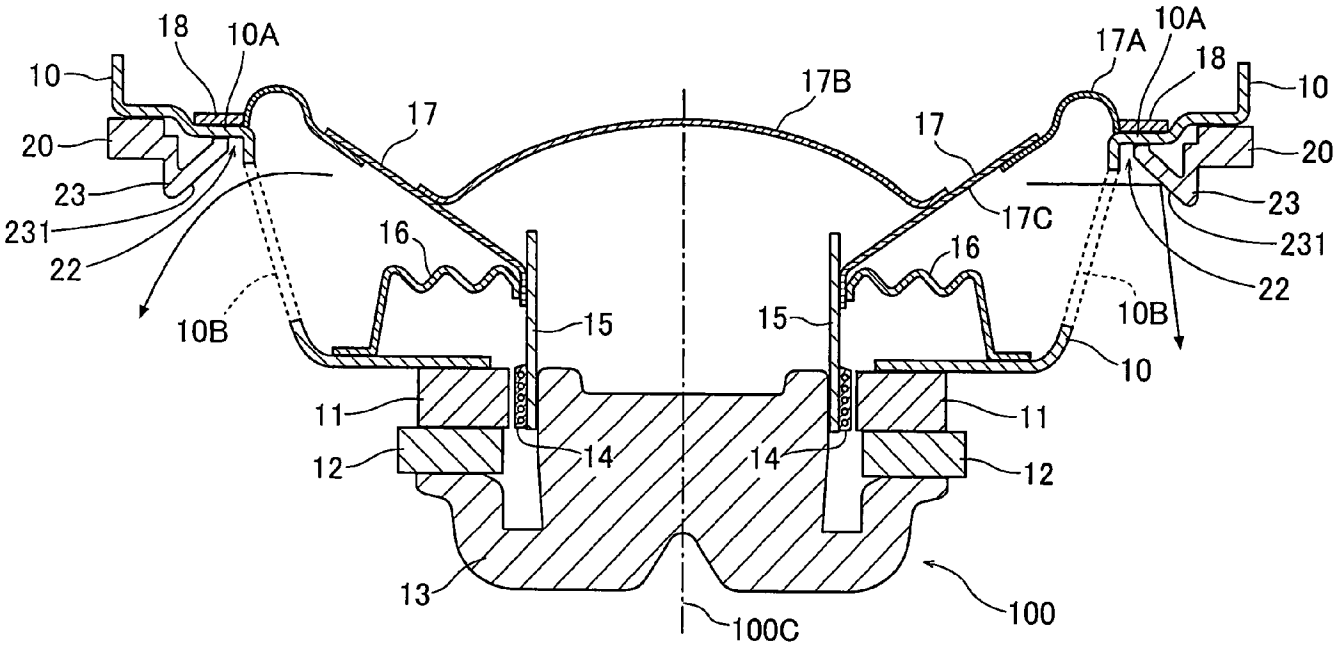
FIG. 4A is a sectional view taken along A-A line of the speaker device illustrated in FIG. 2A.
Figure 4B:
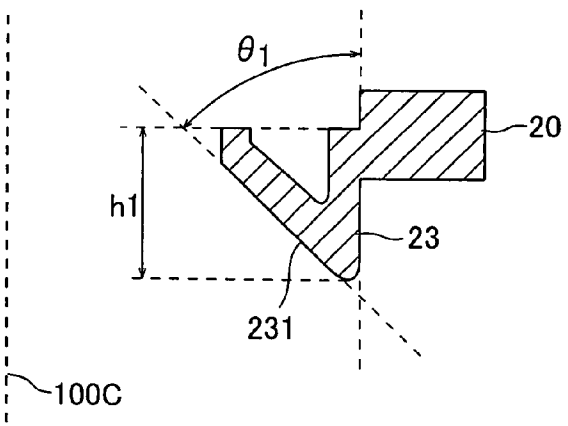
FIG. 4B is an enlarged view showing a reinforcing rib.
Figure 5:
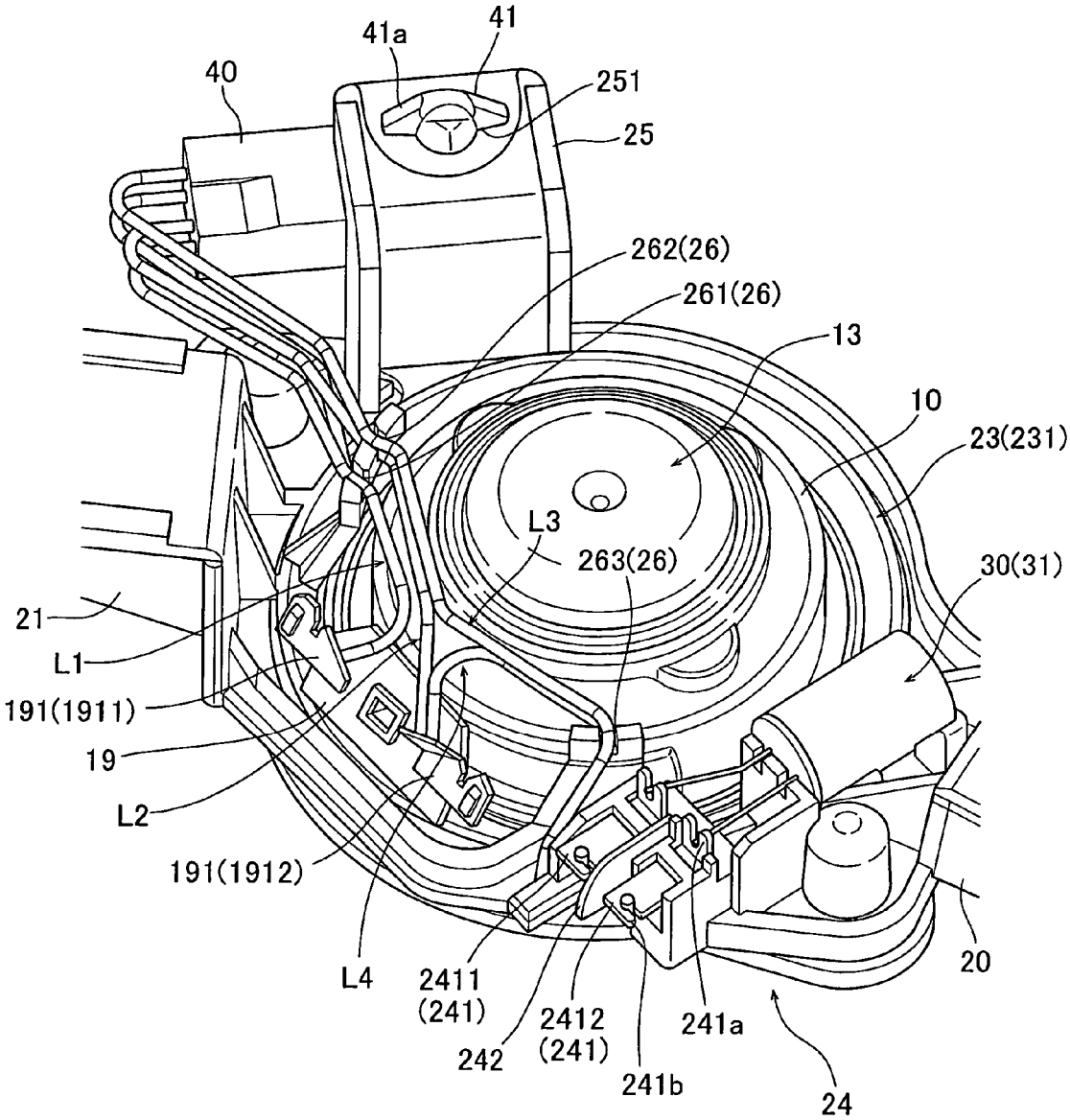
FIG. 5 is a perspective view showing a backside of the speaker device illustrated in FIG. 3.

FIGS. 2A and 2B are explanatory views showing a speaker device formed according to one embodiment of the present invention. FIG. 2A is a front view and FIG. 2B is a side view. FIG. 3 is an explanatory view showing a backside of the speaker device illustrated in FIG. 2. FIG. 4A is a sectional view of the speaker device taken along A-A line in FIG. 2A. FIG. 4B is an enlarged view showing a reinforcing rib. FIG. 5 is a perspective view showing a backside of the speaker device illustrated in FIG. 3. Here, although the following description will be given to explain a cone type speaker device, this should not form any limitation to the present invention. In fact, the present invention also includes speaker devices of dome type, horn type, and plan/flat type. Besides, even with regard to a cone type speaker device, the present invention should not be limited to the configurations described below.

As shown in FIGS. 2 to 5, a speaker device 1 of the present embodiment of the present invention comprises (as a speaker unit 100): a magnetic circuit including a frame 10, a plate 11 attached to the bottom of the frame 10, a permanent magnet 12, and a yoke 13; a voice coil 14 disposed within a magnetic gap formed between the frame 11 and the yoke 13 and driven by an electric signal supplied thereto; a voice-coil bobbin 15 wound by the voice coil 14; a damper 16 supporting the voice-coil bobbin 15 on the frame 10; a diaphragm 17 having an inner perimeter supported on the voice-coil bobbin 15 and an outer perimeter supported through its edge portion 17A on the outer perimeter 10A of the frame 10; and a dust cap 17B formed in the central portion of the diaphragm 17. As shown in FIGS. 3, 4A and 4B, the frame 10 has a plurality of arm portions 10C and openings 10B divided by the arm portions 10C. Further, the outer perimeter of the edge portion 17A of the diaphragm 17 is air-tightly attached to the outer perimeter portion 10A of the frame 10 by virtue of a gasket 18. Here, the voice coil 14 is formed by wiring along the voice-coil bobbin 15 and the diaphragm 17, and such a wiring is connected to a speaker terminal section 191 of a speaker terminal board 19 provided on the backside of the frame 10 by virtue of a flexible wire. In this way, when an electrical signal is supplied to the voice coil 14 through the speaker terminal section 191, the voice-coil bobbin 15 will be driven so as to cause the vibration of the vibrating members such as the diaphragm 17 and the damper 16.

As shown in FIGS. 2 to 5, the speaker device 1 of the present embodiment has an attachment member (attachment bracket) 20 for attaching the speaker unit to an attachment base. As shown, the attachment member 20 has an attachment portion 21, a speaker attaching hole 22, and a reinforcing portion (reinforcing rib) 23. The attachment portion 21 is used to attach the attachment member 20 to an attachment base. Such an attachment portion 21 has, as shown in FIGS. 2 to 5, a plurality of arms 211, 212 having holes 211*a*, 212*a* for fitting fixation members such as screws so as to fix the attachment member 20 to the attachment base. The speaker attaching hole 22 is an opening for attaching the speaker unit 100, so that the speaker unit 100 can be fitted in the opening so as to be fixed in the frame by the screws 110. The reinforcing rib 23 has a function of increasing the strength of the attachment member 20 so as to increase a desired attachment strength. In detail, as shown in FIGS. 3 to 5, a perimeter of the attaching hole 22 on the backside of the attachment member 20 has been entirely or partially formed into a convex portion.

The reinforcing rib 23 may be formed of various materials such as resin, metal, and alloy. The reinforcing rib 23 in the present embodiment, as shown in FIGS. 3 to 5, has an inclined surface 231 formed on the inner side thereof facing the side wall of the speaker unit. In detail, the reinforcing rib 23 has a tapered portion shown in FIGS. 3 to 5, while the inclined surface 231 makes the foregoing inner side generally conic (like a trumpet) and inclined in a direction opposite to the conical inclination of the side wall of the speaker unit. The reinforcing rib 23 carrying the inclined surface 231 has a function which, at the time the diaphragm 17 is vibrating, can smoothly discharge a back pressure from the back side 17*c* of the diaphragm 17 through the opening 10B of the frame 10, and another function which can reduce a resonance phenomenon of the air in the space surrounded by the reinforcing rib 23. Different from the present invention, the aforementioned conventional reinforcing rib 23J has a cylindrical internal space so that the undesired air resonance will occur within such a cylindrical internal space. This problem can be solved by the reinforcing rib 23 of the present embodiment. Namely, the inclined surface 231 is effective in reducing an undesired sound reflection in the internal space and thus can reduce the resonance phenomenon. In this way, the reinforcing rib 23 has not only a function of reinforcing the strength of the attachment member 20, but also a function of reducing a turbulence in the sound characteristic of the speaker unit.

Moreover, the reinforcing rib 23 is such that its inclined surface 231 forms an angle $\theta_1$ with the central axis 100*c* of the speaker unit 100. For example, as shown in FIGS. 4A and 4B, the inclined surface 231 is formed at an angle $\theta_1$ at which a compressional wave of an air from the backside of the diaphragm 17 is emitted, by virtue of the vibration of the diaphragm 17, out of the space defined by the inclined surface 231. In practice, the angle $\theta_1$ of the inclined surface 231 can be set properly by taking into account a reinforcing strength and a degree of turbulence reduction in sound quality characteristic. In more detail, it is preferable to set the inclined surface 231 of the reinforcing rib 23 at an angle of about 45 degrees. In this way, it is possible to ensure a reinforcement effect and to reduce a sound quality deterioration at an acceptable balance. Moreover, when a reinforcement strength based on the reinforcing rib 23 is to be set at a relatively small value, it is allowed to set the height h1 of the reinforcing rib 23 at a relatively small value, and to form the inclined surface 231 of the reinforcing rib 23 at an angle which is larger than 45 degrees and smaller than 90 degrees, thereby inhibiting a sound quality deterioration.

On the other hand, when a reinforcement strength based on the reinforcing rib 23 is to be set at a relatively large value, it is allowed to set the height h1 of the reinforcing rib 23 at a relatively large value, and to form the inclined surface 231 of the reinforcing rib 23 at an angle which is smaller than 45° degrees and larger than 0°, thereby obtaining a relatively large reinforcement strength.

Further, the angle $\theta_1$ of the inclined surface 231 of the reinforcing rib 23 can be suitably set either at a constant angle along the entire circumference of the attachment hole 22, or at different angles at different positions along the circumference. In this way, it is allowed to set a reinforcement strength at certain position along the circumference at a relatively large value, and to reduce a turbulence of a sound characteristic at other position, thereby making it possible to freely obtain desired functions which might be different at different positions along the entire circumference of the attachment hole 22.

Figure 6:
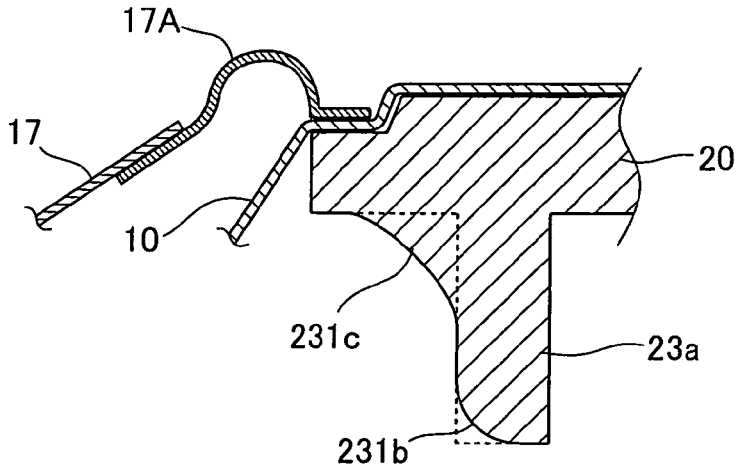
FIG. 6 is a sectional view showing an example of the reinforcing rib.

FIG. 6 is a sectional view showing a detailed example of a reinforcing rib 23*a* of the present invention. As shown, an inclined surface 231 of the reinforcing rib 23*a* has a curved surface formed close to a corner of a convex portion. Namely, this convex corner portion of the reinforcing rib 23*a* is formed into a round corner. In fact, a corner portion 231*b* located on the inner side of the convex portion is formed into a round corner, while another corner portion located close to the root of the convex portion is formed into a curved surface 231*c*. Preferably, the corner portions 231*b* and 231*c* are set to have a relatively large radius of curvature R. In this way, the inner wall of the reinforcing rib 23*a* has a curved surface which is inclined with respect to the center axis 100*c* of the speaker unit. Therefore, it is possible to obtain an effect which is substantially the same as the inclined surface 231 of the foregoing embodiment.

Figure 7:
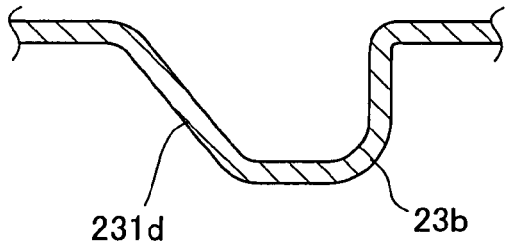
FIG. 7 is a sectional view showing another example of the reinforcing rib.
Figure 8:
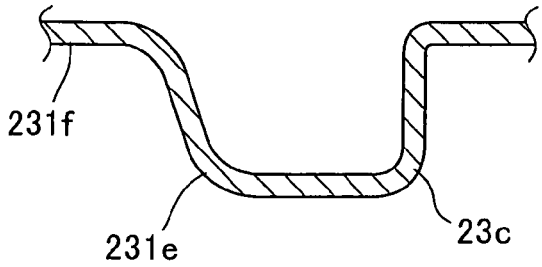
FIG. 8 is a sectional view showing a further example of the reinforcing rib.

Moreover, as shown in FIG. 7, it is also possible to form a reinforcing rib (reinforcing bead) 23*b* using a metal such as iron to form an inclined surface 231*d* on an inner side. Besides, as shown in FIG. 8, it is further possible to form a reinforcing rib 23*c* (so called reinforcing bead) using a metal such as iron to form a round corner portion 231*e* on the inner side of the convex portion. For example, when an attachment member 20 is formed by shaping a metal plate and a reinforcing rib (reinforcing bead) having the aforementioned convex portion is formed, it is possible to obtain substantially the same effect as the foregoing embodiment.

[Electronic Element Attachment Section]

A conventional speaker device has a terminal board 19 located close to the speaker main body on the back side of the frame 1. Directly disposed by means of soldering on the terminal board 19 are electronic elements including a low frequency cut-off capacitor 31, a high frequency cut-off coil, amplifying elements, switching devices and the like. At this time, since the electronic elements are disposed on the terminal board 19, the position for arranging electronic elements in an area forming the terminal board 19 will be limited. Moreover, with regard to a vehicle speaker device, since there is only a limited space (for example, only a gap between the vehicle inner wall and the speaker device) for setting the electronic elements, it is difficult to dispose a plurality of electronic elements large in size.

Different from the above-described conventional speaker device, the speaker device 1 of the present invention, as shown in FIG. 3 and FIG. 5, has a speaker terminal board 19 carrying a terminal section 191 on the backside of the frame 10. The attachment member 20 has an electronic element attachment section 24 located near the attachment hole 22 and carrying an electronic element 30 for controlling an electric signal being inputted into the speaker unit 200. In more detail, the speaker terminal board 19 of the present invention carries a plurality of terminal sections 1911 and 1912, while the electronic element attachment section 24 is formed near the speaker terminal board 19 in a manner shown in FIG. 3 and FIG. 5, and electrically connected to the electronic element 30 attached to the electronic element attachment section 24 as well as to the terminal section 191.

As described above, the electronic element 30 for controlling the signal to be supplied to the speaker is not attached to the speaker terminal board 19, but installed in a manner described below. Namely, in the present invention, the electronic element attachment section 24 is provided on the attachment member 20 and located in a position capable of providing a relatively large space around the speaker unit, so that the electronic element 30 can be attached to the electronic element attachment section 24, thereby making it possible to highly efficiently dispose the electronic element 30 within a limited space near the speaker main body. Further, as compared with the above-described conventional speaker device, the present invention makes it easier to increase a degree of freedom when disposing the electronic element 30, without unfavorably affecting the formation position of the speaker terminal section 191. For example, it is possible to freely set a position for disposing the electronic element 30 in response to a space between the speaker unit and an attachment base. Moreover, it is possible to dispose a plurality of electronic elements such as the capacitor 31 having a relatively large size, a coil, amplifying elements (such as transistor or the like) and a switching device, all in desired positions on the attachment member 20.

Moreover, as shown in FIG. 3 and FIG. 5, the electronic element attachment section 24 of the present embodiment of the present invention has an electrically conductive terminal section (containing metallic terminals) 241 including metallic terminals 2411 and 2412. Further, each of the metallic terminals 2411 and 2412 has at one end thereof a connecting portion 241*a* connected to the electronic element 30 and a wire connecting portion 241*b* connected to an electrically conductive wire (cord).

Further, as shown in FIG. 3 and FIG. 5, the attachment member 20 has a connector terminal attachment section 25 for installing a connector terminal 40. In detail, an engagement member 41 formed in the connector terminal 40 is engaged into an engagement hole 251 formed in the connector terminal attachment section 25, so that the connector terminal 40 can be fixed to the attachment member 20. Further, a retaining portion 41*a* is formed in the engagement member 41 for preventing a dislocation. Here, the connector terminal 40, the speaker terminal 191, and the electronic element 30 are electrically connected to one another through a plurality of wires (cords), as shown in FIG. 5. In more detail, the first terminal portion of the connector terminal 40 is electrically connected to the speaker terminal section 1911 by an electric conductive wire L1, the second terminal portion of the connector terminal 40 is electrically connected to the speaker terminal section 1912 by an electric conductive wire L2, a third terminal of the connector terminal 40 is electrically connected to the metallic terminal 2412 through an electrically conductive wire L3, while the metallic terminal 2411 is electrically connected to the speaker terminal section 1912 through an electrically conductive wire L4.

Moreover, the attachment member 20 has a relay section 26 serving as electrically conductive wire restricting means for restricting the wiring positions of electrically conductive wires. As shown in FIG. 3 and FIG. 5, the relay section 26 includes a plurality of relay portions 261-263. The first relay portion 261 restricts a wiring position of the electrically conductive wire L1 between the connector terminal 40 and the speaker terminal section 1911. The second relay portion 262 restricts a wiring position of the electrically conductive wire L2 between the connector terminal 40 and the speaker terminal section 1912, as well as a wiring position of the electrically conductive wire L3 between the connector terminal 40 and the metallic terminal 2412, while the third relay portion 263 restricts a wiring position of the electrically conductive wire L4 between the metallic terminal 2411 and the speaker terminal section 1912. Further, in the present embodiment of the present invention, the first relay portion 261 and the second relay portion 262 are located adjacent to each other. Besides, as shown in FIG. 5, the relay section 26 of the present embodiment has a groove capable of receiving the electrically conductive wires so as to fix them in position.

As described above, the attachment member 20 has a relay section 26 (electrically conductive wire restricting means) for restricting the wiring positions of electrically conductive wires. Such relay section 26 is provided to restrict at least wiring position of electrically conductive wire between the speaker terminal 191 formed in the frame 10 and the electric element 30 disposed in the electronic element attachment section 24, there by making it possible to exactly fix the electrically conductive wire on the attachment member 20. Further, since the relay portion 263 is provided between the speaker terminal 191 and the metallic terminal 241, when an electrically conductive wire is connected by means of soldering between the speaker terminal 191 and the metallic terminal 241, it is possible to prevent a soldering iron from getting into contact with the electrically conductive wire, thereby preventing the coating of the wire from being melted.

Moreover, since the attachment member 20 has a structure similar to a circuit board in which the metallic terminal 24 formed on the attachment member 20 and the speaker terminal 191 formed in the frame 10 are connected with each other through the relay section 26 by means of electrically conductive wire, and since the connector terminal 40 attached to the connector terminal attachment section 25 and the speaker terminal 191 are connected with each other through the relay section 26 by means of electrically conductive wire, it is possible to more freely set the disposing positions of the essential elements and more easily attach an electronic element such as a capacitor of a large size in the attachment member 20 than the foregoing conventional speaker device. In particular, even with regard to a vehicle speaker device having only a relatively small space for setting the electronic element 30, it is still possible to dispose the electronic element 30 at a desired position on the attachment member 20.

In addition, as shown in FIG. 3 and FIG. 5, a convex protection rib 242 having a predetermined height is provided between the metallic terminals 2411 and 2412, so that it is possible to prevent a short circuit between the metallic terminals 2411 and 2412.

Figure 9:
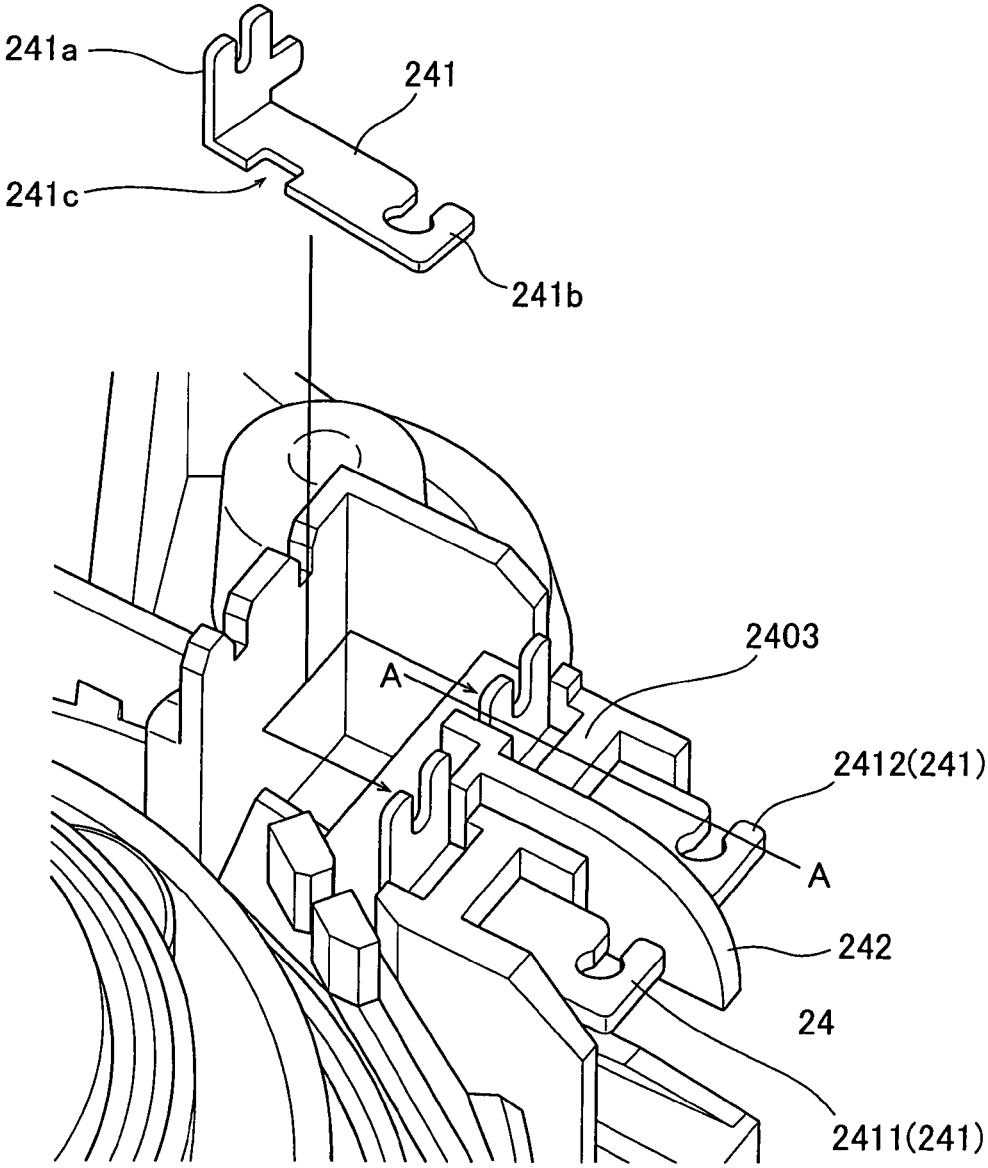
FIG. 9 is a perspective view showing an electrically conductive terminal section (metallic terminal) of an electronic element attachment section according to a first embodiment of the present invention.
Figure 10:
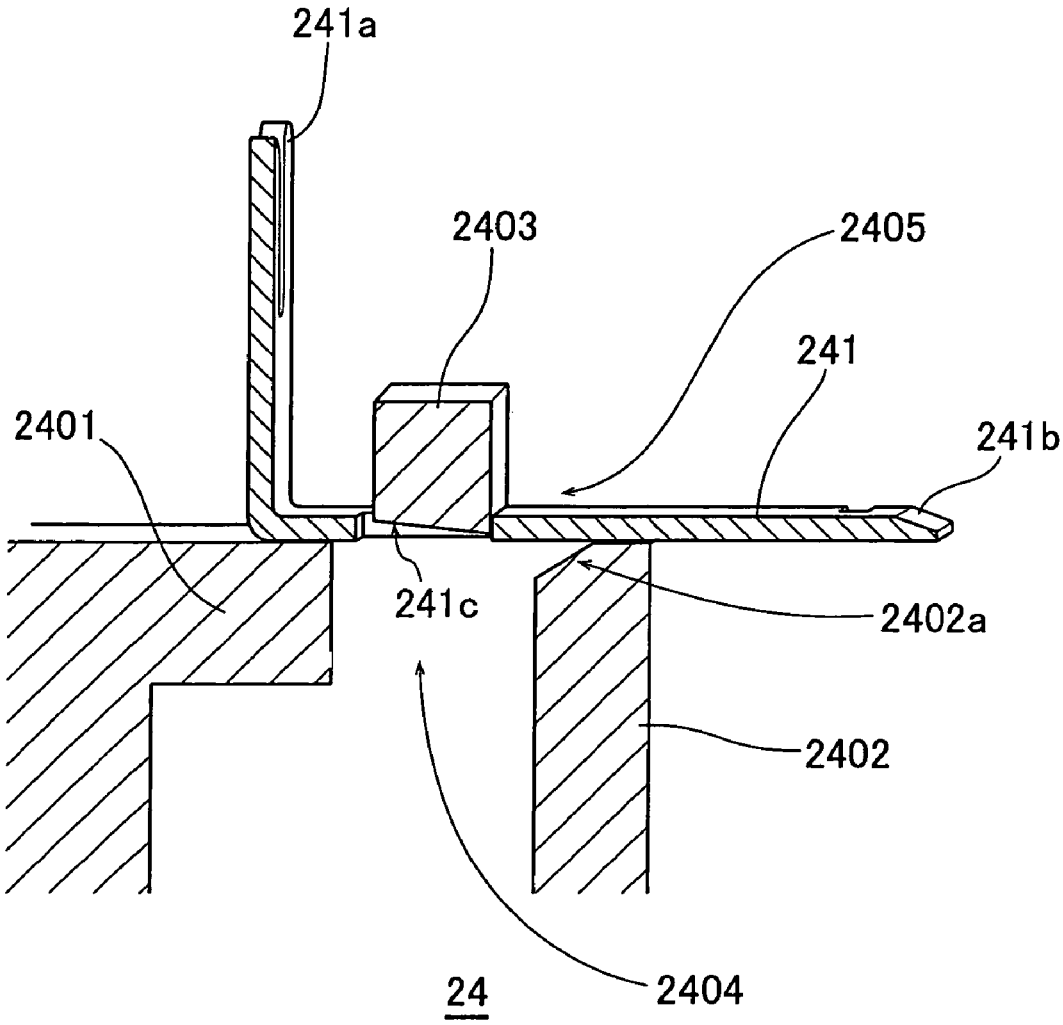
FIG. 10 is a sectional view taken along A-A line shown in FIG. 9.

FIG. 9 is a perspective view showing the electrically conductive terminal section (containing metallic terminals) of the electronic element attachment section formed according to a first embodiment of the present invention. FIG. 10 is a sectional view taken along A-A line in FIG. 9. As shown in FIG. 9 and FIG. 10, each of the metallic terminals 241 (2411, 2412) of the present embodiment is an L-shaped member, having an element connecting portion 241*a* at one end which is connected to the electronic element 30, and an electrically conductive portion 241*b* at the other which is connected to electrically conductive wire (cord). Further, a notch 241*c* is formed near the center on one side of the metallic terminal 241. Moreover, the electronic element attachment section 24 of the attachment member 20 has a first block 2401 and a second block 2402, an engagement block 2403 having a convex portion on a bridge-like inner side, as well as a hollow portion 2404 between the first block 2401 and the second block 2402.

A through hole 2405 defined by the first and second blocks 2401, 2402 as well as an engagement block 2403 allows the metallic terminal 241 to slide from the conductive wire connecting portion 241*b* and pass therethrough, thereby effecting an engagement between the notch 241*c* and the engagement block 2403, thus fixing the metallic terminal 241 with the attachment member 20. Further, an engagement between the notch 241*c* and the engagement block 2403 makes it possible to prevent the metallic terminal 241 from getting dislocated.

Moreover, where the metallic terminal 241 is caused to slide and insert into the through hole, the front end of the second block 2402 can be formed into a tapered corner portion (an inclined surface) 2402*a*, thereby allowing the metallic terminal 241 to easily move over the second block 2402.

Figure 11:
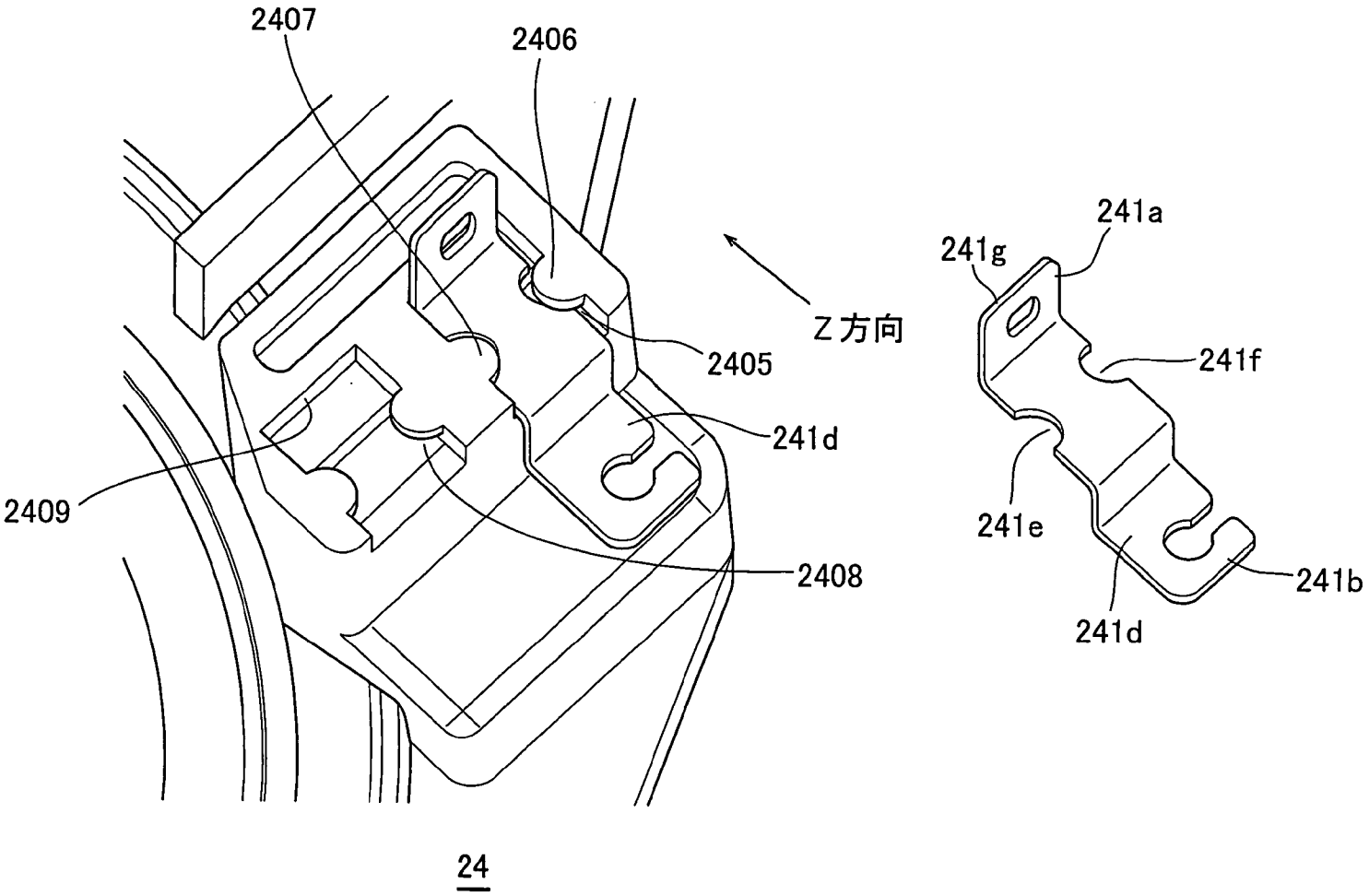
FIG. 11 is a perspective view showing an electrically conductive terminal section (metallic terminal) of an electronic element attachment section according to a second embodiment of the present invention.
Figure 12:
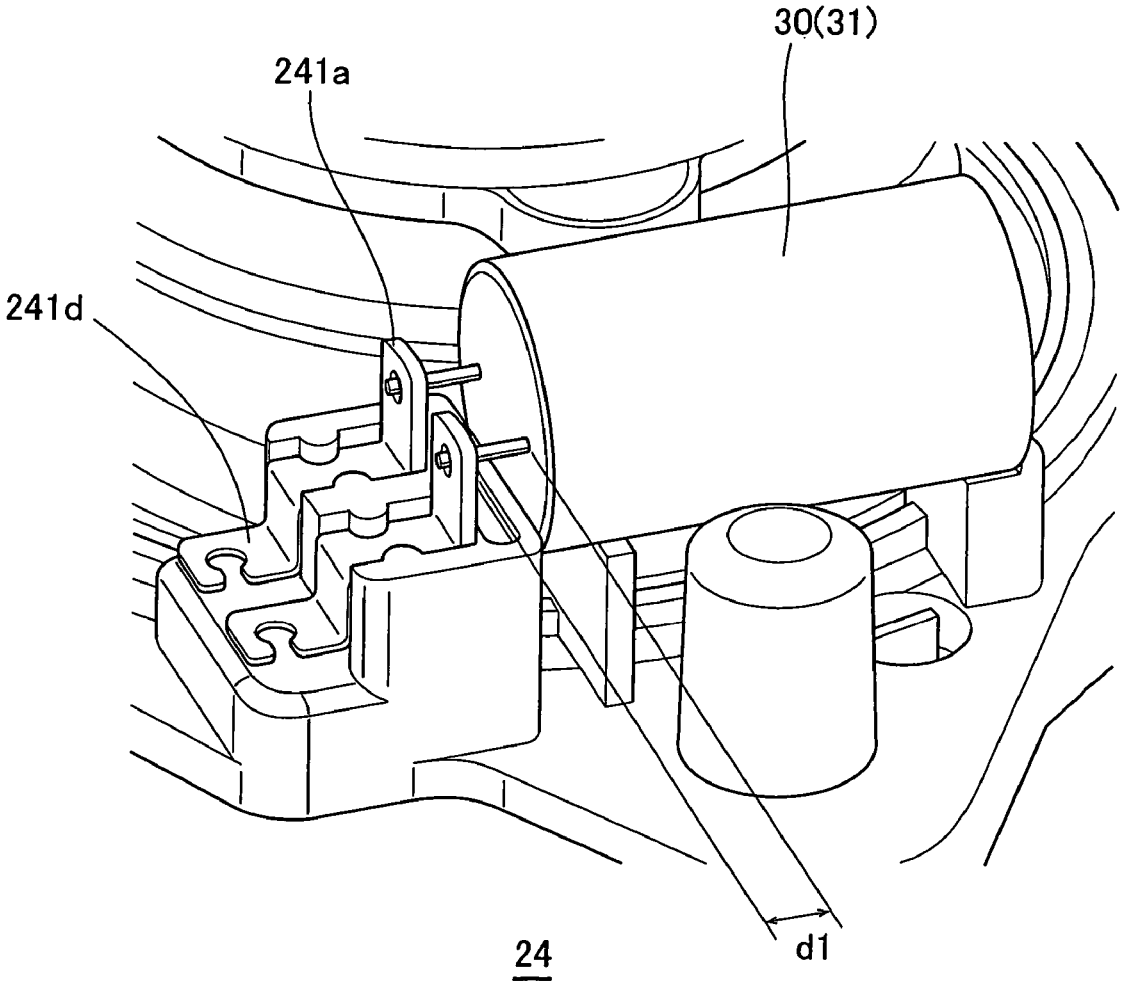
FIG. 12 is an explanatory view showing a connecting relation between the electrically conductive terminal section (metallic terminal) and the electronic element.

FIG. 11 is a perspective view showing an electrically conductive terminal section (metallic terminal) of an electronic element attachment section according to a second embodiment of the present invention. FIG. 12 is also a perspective view showing a connecting relation between the conductive terminal section (metallic terminal) and the foregoing electronic element. However, in the following description given to the second embodiment, some portions which are the same as those of the first embodiment will be partially omitted. As shown in FIG. 11, an electrically conductive terminal 241 is a stepped member, one end of which has an element connecting portion 241*b* connected to the electronic element 30, while the other end of which has an electrically conductive wire connecting portion 241*b* connected to conductive wire (cord). Moreover, notches 241*e*, 241*f* are formed near the central portion of the metallic terminal 241, while a groove 2405 (to be engaged) corresponding to the stepped shape of the metallic terminal 241 is formed in the electronic element attachment section 24 of the attachment member 20. Further, convex portions 2406 and 2407 corresponding to the notches 241*e*, 241*f* of the metallic terminal 241 are formed as facing inwardly near the upper end of the groove 2405 on both sides thereof. In addition, a gap 2480 having a width equal to the thickness of the metallic terminal 241 is formed on the lower side of the convex portions 2406 and 2407.

Then, as shown in FIG. 11, the metallic terminals 241 are attached to the electronic element attachment section 24 having the above-discussed structure by virtue of an engagement between the convex portions 2406, 2407 and the notches 241*e*, 241*f*. Subsequently, with the metallic terminals 241 engaged in the gaps 2408, the metallic terminals 241 are caused to slide in the longitudinal direction (direction of Z axis), thereby allowing an engagement between the inner side faces 2409 of the grooves 2405 (to be engaged) and the side faces 241*g* of the metallic terminals 241, thus fixing the metallic terminals 241 with the attachment member 20. Further, by abutting the upper surfaces of the metallic terminals 241 with the lower surfaces of the convex portions 2406 and 2407, it is possible to realize a function of preventing the metallic terminals 241 from getting dislocated.

Moreover, as shown in FIG. 12, when attaching the metallic terminals 241, the terminals are caused to slide towards a position in which the electronic element 30 is disposed, thereby making it possible to set a connecting distance (a length of terminal conductive portion of the electronic element 30) between the element connecting portion 241*a* and the electronic element 30 at a relatively short length, thus producing a speaker device which is compact in size. Moreover, the above-described structure makes it possible to set the inner surfaces 2409 of the grooves (to be engaged) 2405 as well as the convex portions 2406, 2407 at short lengths, and to form the notches 241*e*, 241*f* of the metallic terminals 241 in positions corresponding to the convex portions 2406 and 2407, thereby making it possible to reduce a sliding amount of the metallic terminals 241 and thus saving an operating space. Further, since the grooves (to be engaged) 2405 are formed in a manner such that the metallic terminals 241 can be directly attached to the attachment member 20, it is possible to reduce the number of parts without providing an additional board for mounting the terminals.

Figure 13A:
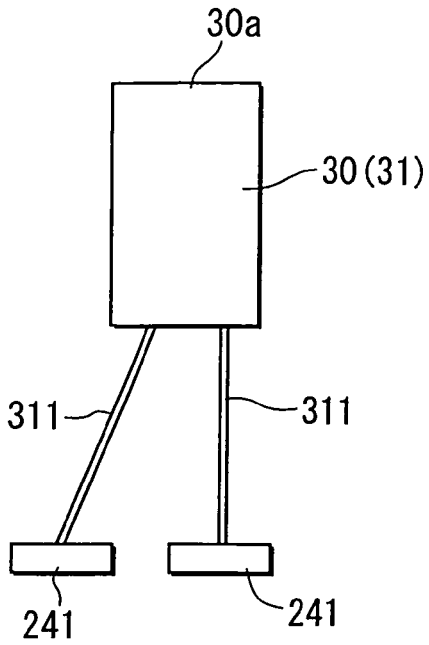
FIG. 13A is an explanatory view showing a conventional attachment structure for an electronic element.
Figure 13B:
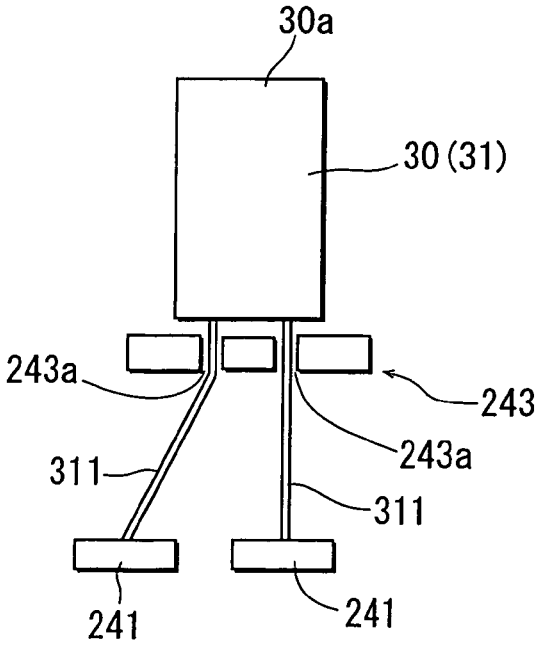
FIG. 13B is also an explanatory view showing an electronic element attachment structure according to one embodiment of the present invention.
Figure 14:
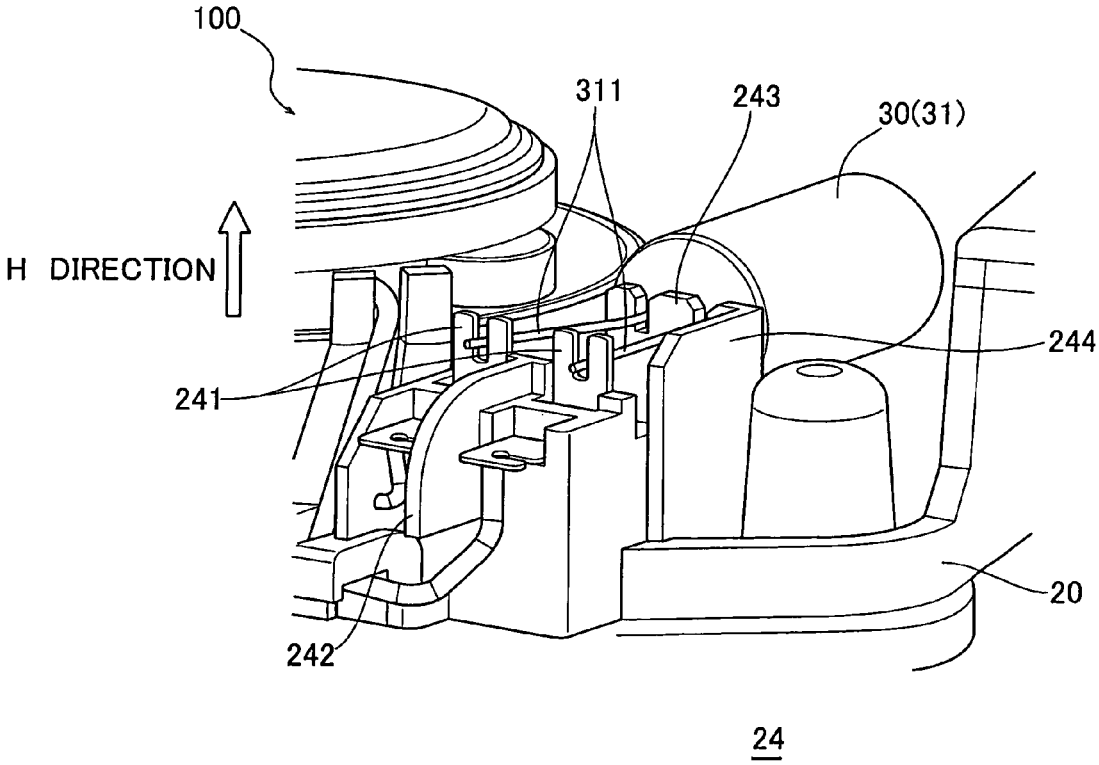
FIG. 14 is a perspective view showing an electronic element attachment structure of the speaker device illustrated in FIG. 3.
Figure 15:
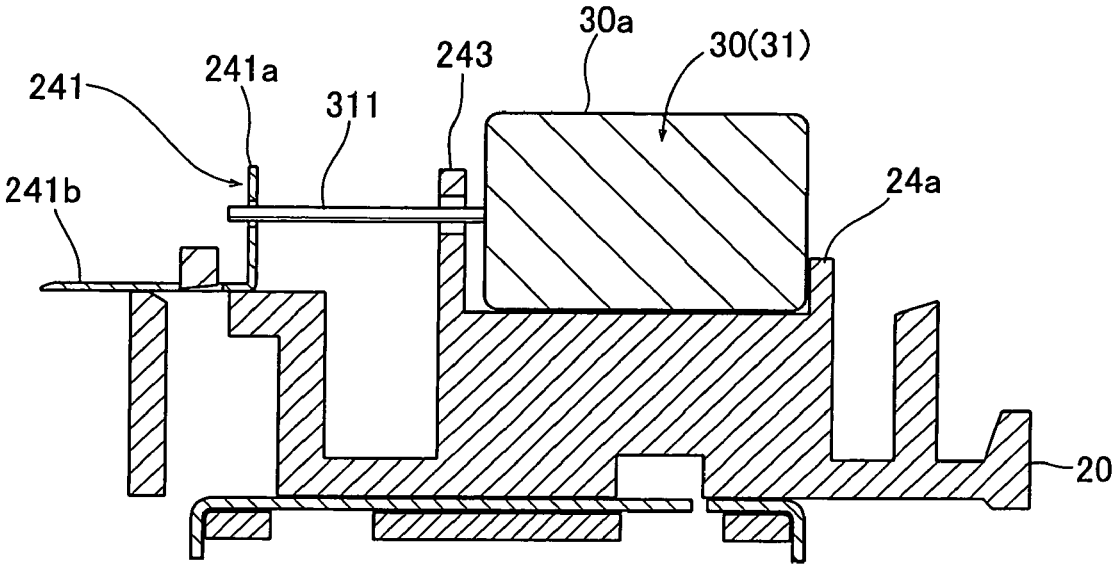
FIG. 15 is a sectional view taken along B-B line of the electronic element attachment section illustrated in FIG. 3.

FIG. 13A is an explanatory view showing a conventional structure for attaching an electronic element, and FIG. 13B is another explanatory view showing an electronic element attachment portion according to one embodiment of the present invention. FIG. 14 is a perspective view showing an electronic element attachment section of the speaker device illustrated in FIG. 3. FIG. 15 is a sectional view taken along B-B line of the electronic element attachment section illustrated in FIG. 3. As shown in FIG. 13A, with regard to the conventional structure for attaching an electronic element, when the lead wires 311 of the capacitor 31 are connected by means of soldering to the metallic terminals 241, if one end of one of the two lead wires 311 is bent to satisfy an interval between two metallic terminals 241, an unnecessary stress will be added in the vicinity of the root portion of the capacitor 31, thus possibly damaging the capacitor 31.

On the other hand, as shown in FIGS. 13B, 14 and 15, the electronic element attachment section 24 of the present embodiment has a lead wire protecting section (protection rib) 243 which protects the lead wires 311 of an electronic element 30 such as a capacitor 31. In detail, as shown in FIGS. 13B, 14 and 15, the protection rib 243 is provided between the electronic element body 30*a* and the metallic terminals 241, and has two notches (engaging portions) separated at substantially the same interval as an interval between the two lead wires 311 of the electronic element 30. When the electronic element 30 is attached to the electronic element attachment section 24, as shown in FIGS. 14 and 15, the electronic element 30 is disposed in an electronic element receiving section 24*a*, while the lead wires 311 are embedded into the notches 243*a*, followed by bending at least one lead wire 311 in a manner such that the end portions of the two lead wires 311 are separated from each other at an interval equal to an interval between the two metallic terminals 241, thereby connecting the end portions of the two lead wires 311 to the respective metallic terminals 241 by means of soldering or the like. At this time, since the lead wires 311 will not be bent to form an interval larger than an interval between the two notches 243*a* near the root portion of the electronic element 30, it is possible to reduce an undesired force being applied to the electronic element body, thus preventing a damage to the electronic element 30.

Figure 16:
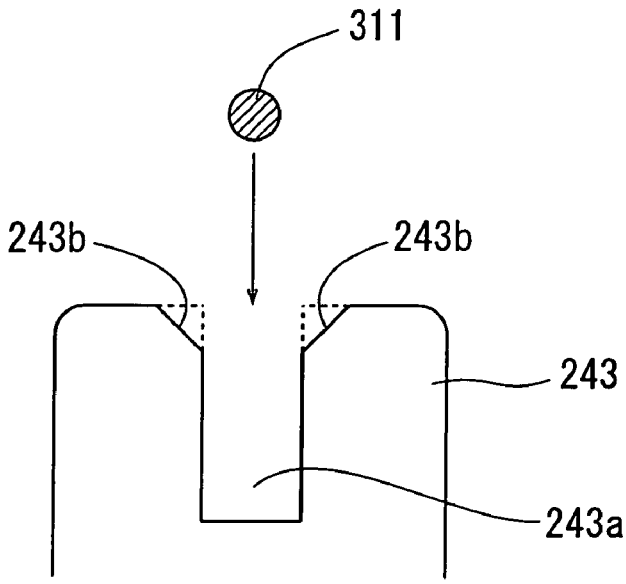
FIG. 16 is an explanatory view showing an example of a protection rib 243.

Moreover, as shown in FIG. 16, it is desirable to form tapered surfaces 243 on the inner corner portions of the notches 243*a* of the protection rib 243. In this way, by providing the protection rib 243 having the above-mentioned configuration, it is possible to improve an operation efficiency when the lead wires are embedded into the notches 243*a*.

Moreover, as shown in FIG. 14, the electronic element attachment section 24 of the present embodiment has a lead wire protection section (protection rib) 244 for protecting the lead wires 311 of the electronic element 30. As shown in FIG. 14, the protection rib 244 is provided between the electronic element body 30*a* and the metallic terminals 241, covering the two lead wires 311 (3111, 3112) of the electronic element 30. In the present embodiment, as shown in FIG. 14, the protection rib 244 is formed to extend to a predetermined height in the vicinity of the two lead wires 311 of the electronic element 30 so as to improve an operation efficiency. In more detail, as shown in FIG. 14, the protection rib 244 is formed higher than the position of the lead wires 311 and arranged in the longitudinal direction (H direction). Preferably, the protection rib 244 is formed as high as possible, and such a protection rib 244 having the above-described configuration makes it possible to protect exposed lead wires 311 from an external force.

Figure 17:
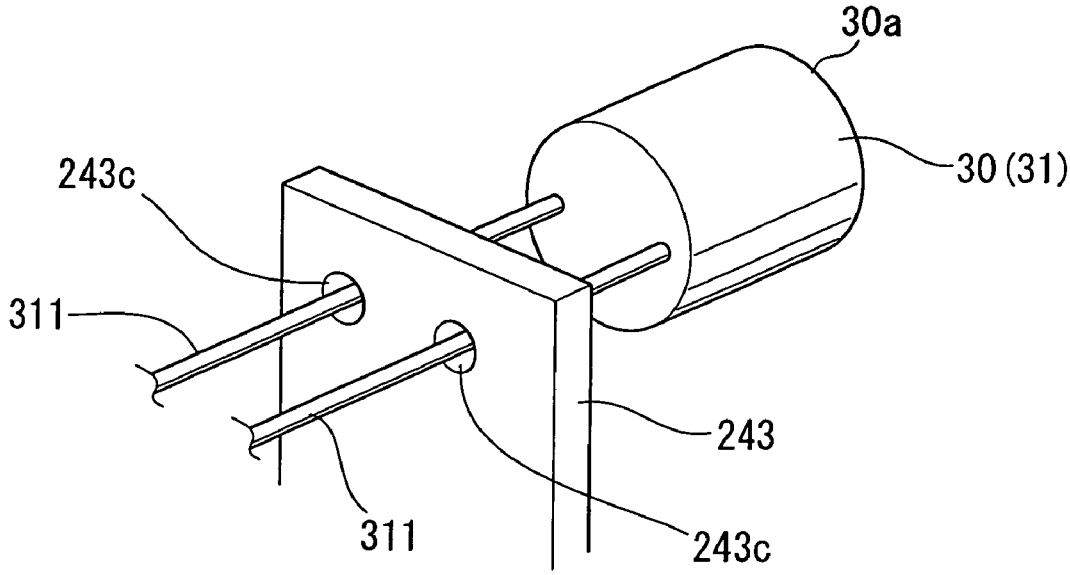
FIG. 17 is an explanatory view showing another example of a protection rib 243.
Figure 18A:
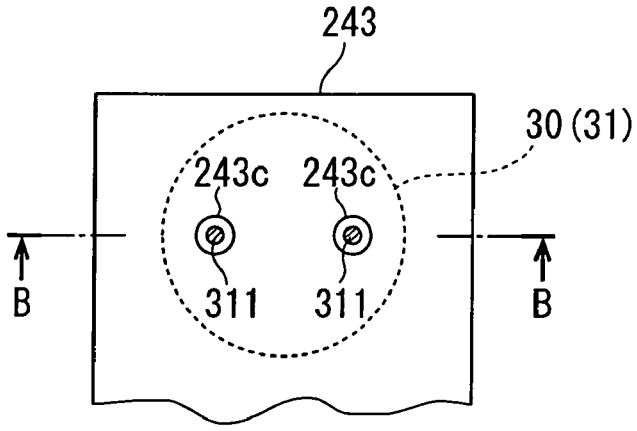
Figure 18B:
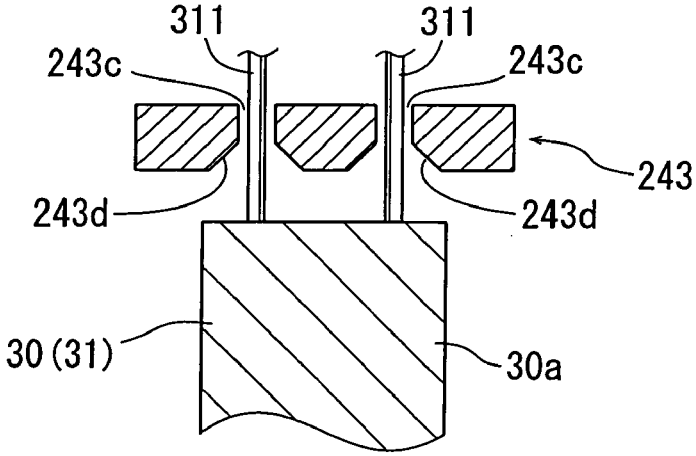
Figure 18C:
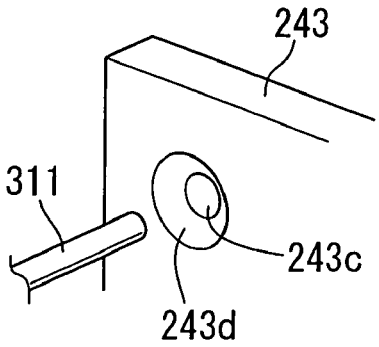

Moreover, as shown in FIG. 17, it is also possible to form two through holes 243*c* instead of notches 243*a* in the protection rib 243, so as to pass the lead wires 311 of the electronic element 30 through the through holes 243*c*. In this way, it is possible for the protection rib 243 having the foregoing configuration to improve its protection function. At this time, as shown in FIGS. 18A to 18C, it is allowed to form tapered portions (inclined surfaces) 243*d* in the through holes 243*c*, thus making it possible to improve an operation efficiency when passing the lead wires 311 through the through holes 243*c*.

Figure 19:
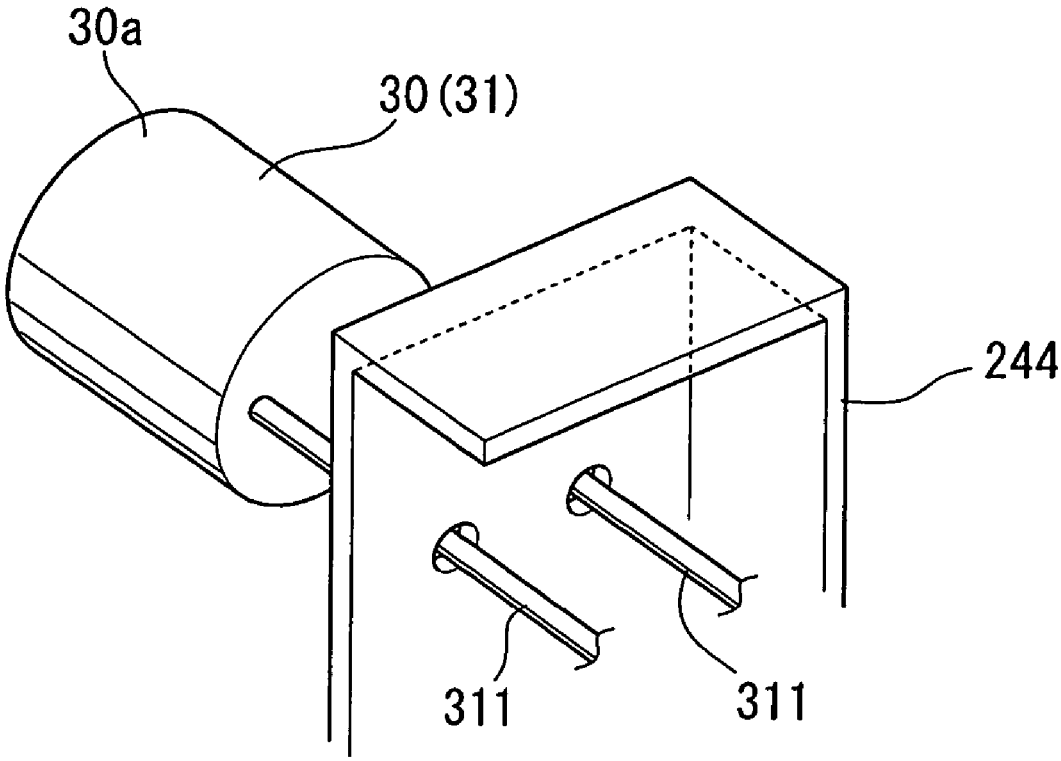
FIG. 19 is a perspective view showing a further example of the protection rib.

Further, as shown in FIG. 19, it is also possible to form the protection rib 244 beside and above the lead wires so as to cover the same. In addition, provision of the protection rib 244 having the foregoing configuration makes it possible to improve its protection function.

However, the above-described embodiments should not form any limitation to the present invention. In fact, it is possible to form a combination including two or more of the above-described embodiments.

Further, although the above-described embodiments are based on vehicle speaker device, this should not form any limitation to the present invention. In practice, the attachment section 21, the attachment hole 22 and the reinforcing rib 23 should not be limited to the above-described configurations, but can be formed into any other desired shapes if necessary.

As describe above, the speaker device 1 comprises a speaker unit 100, an attachment member 20 for attaching the speaker unit 100 to an attachment base. The attachment member 20 comprises an attachment portion 21 for attaching the attachment member 20 to the attachment base, an attachment hole 22 for attaching the speaker unit, a convex reinforcing portion 23 formed along an entire or partial circumference of the attachment hole of the attachment member. The reinforcing portion 23 has an inclined surface 231 formed on the inner side thereof facing the side wall of the speaker unit, so that an air compressional wave generated by the vibration of the diaphragm 17 of the speaker unit 100 can be reflected on the inclined surface 231 formed on the inner side of the reinforcing portion 23 and then emitted out of the space defined by the reinforcing portion 23. As a result, it is possible to reduce an undesired resonance phenomena in the space defined by the reinforcing portion 23, thereby inhibiting a deterioration of a sound characteristic of the speaker unit. Moreover, since an air compressional wave generated by the vibration of the diaphragm 17 of the speaker unit 100 can be smoothly discharged by virtue of the inclined surface 231 of the reinforcing member 23, there would be no unnecessary restriction on the vibration of the diaphragm 17, thereby making it possible to reduce a turbulence of the sound characteristic.

Besides, since the reinforcing portion 23 is formed into a generally conical shape whose inner side face is inclined in a direction opposite to a conical inclination of the side face of the speaker unit, it is possible to increase a reinforcing strength and reduce a turbulence of the sound characteristic.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A speaker device having a speaker unit and an attachment member for attaching the speaker unit to an attachment base, said attachment member comprising:

an electronic element attachment section for mounting an electronic element which controls an electric signal being inputted into the speaker unit, wherein the electronic element attachment section comprises:

an electronically conductive terminal section having one end connected to said electronic element and the other to a speaker terminal section formed in the speaker unit, and having notches formed near the center thereof on side portions; and through holes having engaging portions formed on inner surfaces thereof, wherein electrically conductive terminals are inserted in the through holes such that the notches of electrically conductive terminals and engaging portions are engaged with each other to fix the electrically conductive terminal section.

2. The speaker device according to claim 1, wherein the electronic element attachment section comprises:

convex portion formed near upper end portion of inner side wall and facing inwardly;

engagement portion having gap formed on bottom side of convex portion for engaging electrically conductive terminal;

electrically conductive terminal having notch formed corresponding to convex portion, wherein under a condition in which convex portion of engagement portion and notch of electrically conductive terminal are engaged with each other so that electrically conductive terminal is engaged in gap of engagement portion, the electrically conductive terminal is slide so as to be fixed.

3. The speaker device according to claim 1, wherein the electronic element attachment section has a lead wire protection unit for protecting the lead wires of the electronic element.

4. The speaker device according to claim 3, wherein the electronic element has a plurality of lead wires provided at a predetermined interval on the main body of the electronic element, wherein the lead wire protection unit is provided between the electronic element main body and an electrically conductive terminal section connected with the lead wires of the electronic element, and has engagement portions formed at the same interval as the foregoing predetermined interval for engaging the lead wires.

5. The speaker device according to claim 1, said attachment member further comprising:

an attachment portion to be attached to the attachment base;

an attachment hole for fitting the speaker unit; and a reinforcing portion formed along an entire or partial circumference of the attachment hole and generally shaped in a concentric circle with the speaker unit;

wherein said reinforcing portion is formed with an inclined surface, on the inner side facing a side wall of the speaker unit.

6. The speaker device according to claim 5, wherein said reinforcing portion has an inner side wall which is generally conically shaped and inclined in a direction opposite to a conical inclination of a side wall of the speaker unit.

7. The speaker device according to claim 5 wherein the inclined surface of the reinforcing portion has an inclining angle which varies along the circumferential direction of the perimeter of the attachment hole.

8. The speaker device, according to claim 5, wherein the inclined surface of the reinforcing portion has an inclining angle of about 45°.

9. The speaker device according to claim 5, wherein said inclined surface is a curved surface formed around a corner of a convex reinforcing portion.

10. The speaker device according to claim 5, wherein said attachment member has said reinforcing portion which is made from a processed metal plate and has a convex shape.

11. The speaker device according to claim 5, wherein the electronic element attached to the electronic element attachment section is electrically connected to a speaker terminal section formed in the speaker unit.

12. The speaker device according to claim 5, wherein the attachment member has electrically conductive wire restricting means for restricting the wiring positions of electrically conductive wires connected between a speaker terminal section formed in the speaker unit and an electronic element attached to the electronic element attachment section.

* * * * *